US011217161B2

(12) United States Patent
Yin

(10) Patent No.: US 11,217,161 B2
(45) Date of Patent: Jan. 4, 2022

(54) DISPLAY-DRIVING CIRCUIT, METHOD, AND DISPLAY APPARATUS

(71) Applicant: BOE Technology Group Co., Ltd., Beijing (CN)

(72) Inventor: Xinshe Yin, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 302 days.

(21) Appl. No.: 16/486,013

(22) PCT Filed: Sep. 20, 2018

(86) PCT No.: PCT/CN2018/106722
§ 371 (c)(1),
(2) Date: Aug. 14, 2019

(87) PCT Pub. No.: WO2020/056672
PCT Pub. Date: Mar. 26, 2020

(65) Prior Publication Data

US 2021/0335234 A1 Oct. 28, 2021

(51) Int. Cl.
*G09G 3/32* (2016.01)
*G09G 3/3233* (2016.01)
(Continued)

(52) U.S. Cl.
CPC ..... *G09G 3/3233* (2013.01); *G09G 3/3266* (2013.01); *G09G 3/3291* (2013.01);
(Continued)

(58) Field of Classification Search
CPC ... G09G 2300/0819; G09G 2300/0842; G09G 2300/0852; G09G 2310/0286;
(Continued)

(56) References Cited

U.S. PATENT DOCUMENTS 7,317,400 B2 * 1/2008 Sato ..... G09G 3/006 324/500
2004/0017161 A1 * 1/2004 Choi ..... G09G 3/3233 315/169.3
(Continued)

FOREIGN PATENT DOCUMENTS

CN 1910640 A 2/2007
CN 102005178 A 4/2011
(Continued)

OTHER PUBLICATIONS

International Search Report & Written Opinion dated Jun. 4, 2019, regarding PCT/CN2018/106722.
(Continued)

*Primary Examiner* — Michael J Eurice
(74) *Attorney, Agent, or Firm* — Intellectual Valley Law, P.C.

(57) ABSTRACT

The present application discloses a display-driving circuit including a pixel sub-circuit, a sensing-control sub-circuit, and an emission-control sub-circuit. The pixel sub-circuit includes four transistors and one storage capacitor and is coupled respectively with a first power-supply line, a data-sensing line, a first scan line, and a second scan line to determine a drive current flowing from a driving transistor to a light-emitting diode based on a data signal received via the data-sensing line. The sensing-control sub-circuit is coupled between the light-emitting diode and the first power-supply line and configured to enable a sensing signal to be detected via the data-sensing line with a reduced scan rate in a sensing time. The emission-control sub-circuit is coupled between the light-emitting diode and a second power-supply line to pass the drive current for driving the light-emitting diode to emit light under control of an emis-
(Continued)

sion-control signal in a displaying time after the sensing time.

17 Claims, 9 Drawing Sheets

(51) Int. Cl.
*G09G 3/3291* (2016.01)
*G09G 3/3266* (2016.01)

(52) U.S. Cl.
CPC ..... *G09G 2300/0426* (2013.01); *G09G 2310/0294* (2013.01); *G09G 2310/061* (2013.01); *G09G 2330/028* (2013.01)

(58) Field of Classification Search
CPC ..... G09G 2310/0294; G09G 2310/061; G09G 2320/0233; G09G 2320/0295; G09G 2320/043; G09G 2320/045; G09G 2330/028; G09G 3/32; G09G 3/3225; G09G 3/3233; G09G 3/3283; G09G 3/3291; G09G 2300/0809; G06F 3/04166
See application file for complete search history.

(56) References Cited

U.S. PATENT DOCUMENTS

2005/0168490 A1* 8/2005 Takahara ..... G09G 3/2014 345/690
2007/0164959 A1 7/2007 Childs
2010/0045646 A1* 2/2010 Kishi ..... G09G 3/3291 345/211
2011/0050741 A1* 3/2011 Jeong ..... G09G 3/3291 345/690
2011/0063214 A1* 3/2011 Knapp ..... H04L 12/43 345/158
2013/0050292 A1* 2/2013 Mizukoshi ..... G09G 3/3291 345/690
2014/0168195 A1* 6/2014 Kumeta ..... G09G 3/3233 345/212
2015/0179105 A1* 6/2015 Mizukoshi ..... G09G 3/3266 345/76
2015/0294626 A1* 10/2015 Bi ..... G09G 3/3233 345/211
2016/0012799 A1* 1/2016 Kim ..... G09G 3/3208 345/205
2016/0062522 A1* 3/2016 Yang ..... G09G 3/3291 345/174
2016/0062548 A1* 3/2016 Kwon ..... G06F 3/042 345/173
2016/0103513 A1* 4/2016 Yang ..... G06F 3/042 345/175
2016/0125811 A1* 5/2016 Park ..... G09G 3/3258 345/694
2016/0189612 A1* 6/2016 Lee ..... G09G 3/2003 345/690
2016/0343278 A1* 11/2016 Tsujita ..... G09G 3/3233
2016/0351095 A1* 12/2016 Tani ..... G09G 3/3283
2017/0110052 A1* 4/2017 Kuo ..... G09G 3/30
2017/0162121 A1* 6/2017 Yang ..... G09G 3/3233
2018/0061292 A1* 3/2018 Hong ..... G09G 3/006
2018/0137825 A1* 5/2018 An ..... G09G 3/3266
2018/0182278 A1* 6/2018 Kim ..... G09G 3/3233
2020/0051500 A1* 2/2020 Lin ..... G09G 3/3258

FOREIGN PATENT DOCUMENTS

CN 102097055 A 6/2011
CN 102968954 A 3/2013
CN 104732920 A 6/2015
CN 107564473 A 1/2018
CN 108074528 A 5/2018

OTHER PUBLICATIONS

First Office Action in the Chinese Patent Application No. 201880001427.X, dated Oct. 9, 2020; English translation attached.

* cited by examiner

DISPLAY-DRIVING CIRCUIT, METHOD, AND DISPLAY APPARATUS

CROSS-REFERENCE TO RELATED APPLICATION

This application is a national stage application under 35 U.S.C. § 371 of International Application No. PCT/CN2018/106722, filed Sep. 20, 2018, the contents of which are incorporated by reference in the entirety.

TECHNICAL FIELD

The present invention relates to display technology, more particularly, to a display-driving circuit, a method, and a display apparatus having the same.

BACKGROUND

Basic operation principle of driving an organic light-emitting diode (OLED) based pixel in an OLED display panel is to use a thin-film transistor served as a driving transistor to control a drive current. Typically, a pixel circuit is configured to have the driving transistor being connected with a driving power voltage source ELVDD and the OLED in series. The gate electrode of the driving transistor is connected to a voltage source representing digital grayscale levels via a switch transistor that is controlled by a scan signal Gate. Although the pixel circuit mentioned above is a simplest way to achieve a controlled supply of the drive current to the OLED, but the drive current has a dependency of a threshold voltage $V_{th}$ of the driving transistor in a square power relationship, leading to large deviation of the drive current even for 0.1V drift in $V_{th}$ due to manufacture non-uniformity or changes in environmental condition. This results in a deviation in the pixel luminance and causes image brightness non-uniformity across the OLED display panel.

It is desired to design an improved display-driving circuit with threshold voltage compensation and reduction of signal line layout for the OLED display panel.

SUMMARY

In an aspect, the present disclosure provides a display-driving circuit of a subpixel in a display panel. The display-driving circuit includes a pixel sub-circuit coupled respectively with a first power-supply line, a data-sensing line, a first scan line, and a second scan line. The pixel sub-circuit includes a driving transistor to determine a drive current flowing to a first electrode of a light-emitting diode based on a data signal received via the data-sensing line during a displaying time. Additionally, the display-driving circuit includes a sensing-control sub-circuit coupled between a second electrode of the light-emitting diode and the first power-supply line and configured to cut off the drive current through the light-emitting diode under control of a sensing-control signal and to allow a sensing signal to be detected in the data-sensing line in a sensing-scan period in a non-displaying time. Furthermore, the display-driving circuit includes an emission-control sub-circuit coupled between the second electrode of the light-emitting diode and a second power-supply line and configured to pass the drive current for driving the light-emitting diode to emit light under control of an emission-control signal in a data-scan period in the displaying time.

Optionally, the driving transistor in the pixel sub-circuit includes a source electrode coupled to the first power-supply line, a drain electrode coupled to the first electrode of the light-emitting diode, and a gate electrode coupled to a first node. The pixel sub-circuit further includes a second transistor having a source electrode coupled to the first node, a drain electrode coupled to the first electrode of the light-emitting diode, and a gate electrode coupled to the second scan line. The pixel sub-circuit also includes a fourth transistor having a source electrode coupled to the data-sensing line, a drain electrode coupled to the first node, and a gate electrode coupled to the first scan line. Furthermore, the pixel sub-circuit includes a storage capacitor coupled between the source electrode and the gate electrode of the driving transistor.

Optionally, the pixel sub-circuit includes a second transistor having a source electrode coupled to the first node, a drain electrode coupled to the first electrode of the light-emitting diode, and a gate electrode coupled to the second scan line. Additionally, the pixel sub-circuit includes a third transistor having a source electrode coupled to the data-sensing line, a drain electrode coupled to the first node, and a gate electrode coupled to the second scan line. Furthermore, the pixel sub-circuit includes a fourth transistor having a source electrode coupled to the data-sensing line, a drain electrode coupled to the first node, and a gate electrode coupled to the first scan line. Moreover, the pixel sub-circuit includes a storage capacitor coupled between the source electrode and the gate electrode of the driving transistor.

Optionally, the sensing-control sub-circuit includes a sensing-control transistor having a source electrode coupled to the first power-supply line, a drain electrode coupled to the second electrode of the light-emitting diode, and a gate electrode being supplied with the sensing-control signal. The sensing-control transistor is turned on during the sensing-scan period to set a high voltage level from the first power-supply line to the second electrode of the light-emitting diode to make it in reversed-bias mode.

Optionally, the emission-control sub-circuit includes an emission-control transistor having a source electrode coupled to the second power-supply line, a drain electrode coupled to the second electrode of the light-emitting diode, and a gate electrode being supplied with the emission-control signal. The emission-control transistor is turned on during the displaying time to connect the second electrode of the light-emitting diode to a low voltage level or ground level set for the second power-supply line.

Optionally, the display-driving circuit further includes a reset sub-circuit. The reset sub-circuit includes a reset-transistor having a drain electrode coupled to the data-sensing line, a source electrode coupled to a voltage terminal, and a gate electrode coupled a reset terminal. The gate electrode is controlled by a reset signal from the reset terminal to set the data-sensing line to an initializing voltage in a resetting sub-period imposed at a beginning of the sensing-scan period in the non-displaying time. The initializing voltage is set to be smaller than the high voltage level from the first power-supply line minus a threshold voltage of the driving transistor.

Optionally, the data-sensing line is configured in the sensing-scan period per row to store the sensing signal bearing a first voltage which is substantially charged from the initializing voltage up to the high voltage level minus the threshold voltage in a $V_{th}$-establishing sub-period after the resetting sub-period.

Optionally, the sensing-scan period is a unit time of scanning progressively one row after another through the display panel within a sensing time. The sensing time is placed between a system-setting time after power-on and a beginning of the displaying time, and/or placed between an end of the displaying time and a system-resetting time before power-off.

Optionally, the data-sensing line is alternatively configured in the data-scan period per row to load the data signal containing an original pixel voltage corresponding to the subpixel in a row that is currently been scanned plus the threshold voltage of the driving transistor based on the sensing signal detected from a same data-sensing line during the non-displaying time.

Optionally, the data-scan period includes a unit time of scanning progressively one row after another through the display panel within one frame of the displaying time. The one frame includes a vertical blank time between an end of scanning a last row in a current frame and a beginning of scanning a first row in next frame.

Optionally, the light-emitting diode is an organic light-emitting diode. The first electrode of the light-emitting diode is an anode and the second electrode of the light-emitting diode is a cathode.

In another aspect, the present disclosure provides a method for driving a display panel. The method includes powering on the display panel to provide a power-supply voltage and system shift-register signals to a respective one pixel sub-circuit of a plurality of pixel sub-circuits in a system-setting time of a non-displaying time. Each of the plurality of pixel sub-circuits comprises a driving transistor and associated with a corresponding subpixel having a light-emitting diode. Additionally, the method includes sampling and storing a sensing signal from a data-sensing line of the respective one pixel sub-circuit in one row of subpixels when sequentially scanning one row after another through the display panel with a first scanning rate in a first sensing time following the system-setting time. Furthermore, the method includes driving the respective one pixel sub-circuit to determine a drive current flowing to the light-emitting diode to drive light emission for displaying a subpixel image based on a corresponding data signal loaded to the data-sensing line of the respective one pixel sub-circuit when sequentially scanning one row after another through the display panel with a second scanning rate in each frame of a displaying time following the non-displaying time. The corresponding data signal is compensated based on the sensing signal sampled for the corresponding subpixel and stored in the first sensing time.

Optionally, the step of powering up the display panel includes providing the power-supply voltage to a first power-supply line coupled to a source electrode of a driving transistor in the respective one pixel sub-circuit. The driving transistor has a drain electrode coupled in series to a first electrode of the light-emitting diode. The step of powering up the display panel further includes providing a first scan signal based on one of the system shift-register signals to a first scan line coupled to a gate electrode of a fourth transistor in the respective one pixel sub-circuit. The fourth transistor has a source electrode coupled to the data-sensing line and a drain electrode coupled to the gate electrode of the driving transistor. Additionally, the step of powering up the display panel includes providing a second scan signal based on another of the system shift-register signals to a second scan line coupled to gate electrodes of both a second transistor and a third transistor in the respective one pixel sub-circuit. The second transistor has a source electrode coupled to the gate electrode of the driving transistor and a drain electrode coupled to the first electrode of the light-emitting diode. The third transistor has a source electrode coupled to the data-sensing line and a drain electrode coupled to the gate electrode of the driving transistor. The light-emitting diode in the corresponding subpixel has a second electrode being coupled via a sensing-control sub-circuit to the first power-supply line and coupled via an emission-control sub-circuit to a second power-supply line. The sensing-control sub-circuit includes a sensing-control transistor with a source electrode coupled to the first power-supply line, a drain electrode coupled to the second electrode of the light-emitting diode, and a gate electrode served as a first control terminal thereof. The emission-control sub-circuit includes an emission-control transistor having a source electrode coupled to the second power-supply line, a drain electrode coupled to the second electrode of the light-emitting diode, and a gate electrode served as a second control terminal thereof. Each of the driving transistor, the second transistor, the third transistor, the fourth transistor, the sensing-control transistor, and the emission-control transistor is a p-type transistor.

Optionally, the steps of sampling and storing the sensing signal include, in the non-displaying time, applying a sensing-control signal at a low voltage to the first control terminal of the sensing-control sub-circuit and applying an emission-control signal at a high voltage to the second control terminal of an emission-control sub-circuit to enable a sensing function of the respective one pixel sub-circuit. The steps of sampling and storing the sensing signal further include keeping the first scan signal at a high voltage in the first sensing time and setting the second scan signal to a low voltage with a pulse width of one sensing-scan period per row in the first sensing time for progressively scanning one row after another through the display panel. Additionally, the steps of sampling and storing the sensing signal include initializing the data-sensing line of the respective one pixel sub-circuit to an initializing voltage in a resetting sub-period in each sensing-scan period per row. The initializing voltage is set to be smaller than the power-supply voltage minus a threshold voltage of the driving transistor. Furthermore, the steps of sampling and storing the sensing signal include charging the storage capacitor by the power-supply voltage via the driving transistor and the second transistor to a first voltage equal to the power-supply voltage minus the threshold voltage in an establishing sub-period following the reset sub-period in each sensing-scan period per row. The steps of sampling and storing the sensing signal further include storing the first voltage into a parasitic capacitor associated with the data-sensing line via the fourth transistor in the establishing sub-period. Moreover, the steps of sampling and storing the sensing signal include sensing the sensing signal carrying the first voltage from the data-sensing line and storing the threshold voltage into a memory of an external compensation module in a sampling sub-period following the establishing sub-period in each sensing-scan period per row.

Optionally, the step of applying the sensing-control signal at the low voltage includes turning the sensing-control transistor on to set the second electrode of light-emitting diode to the power-supply voltage for making the light-emitting diode in a reversed bias mode without light emission in the non-displaying time. The step of applying the emission-control signal at the high voltage includes turning the emission-control transistor off to disconnect the second electrode of the light-emitting diode from a second power-supply line.

Optionally, the sensing-scan period per row includes a time duration equal to or less than an inverse value of the first scanning rate. The first scanning rate is configured to be in a range of one tenth to one sixtieth of the second scanning rate. The second scanning rate is normally for the display panel to display image progressively one frame after another in the displaying time.

Optionally, the step of driving the pixel sub-circuit includes, in the displaying time, applying a sensing-control signal at a high voltage to the first control terminal of the sensing-control sub-circuit and applying an emission-control signal at a low voltage to the second control terminal of the emission-control sub-circuit to enable an emission function of the respective one pixel sub-circuit.

Optionally, the step of applying the sensing-control signal at the high voltage includes turning the sensing-control transistor off to disconnect the second electrode of the light-emitting diode from the first power-supply line. The step of applying the emission-control signal at the low voltage includes turning the emission-control transistor on to set the second electrode of light-emitting diode to a low voltage or ground voltage for making the light-emitting diode in a positive bias mode in the displaying time.

Optionally, the step of driving the pixel sub-circuit further includes keeping the second scan signal at a high voltage in the displaying time. The step of driving pixel sub-circuit also includes setting the first scan signal to a low voltage with a pulse width of one data-scan period per row to load a data voltage via the data-sensing line to the gate electrode of the driving transistor of the respective one pixel sub-circuit of the corresponding subpixel in a row currently scanned in the data-scan period per row in each frame of the displaying time for progressively scanning from one row to next through the display panel. The data voltage is equal to an original pixel voltage plus the threshold voltage stored in the memory of the external compensation module. Additionally, the step of driving the pixel sub-circuit includes storing a second voltage equal to the power-supply voltage minus data voltage to the storage capacitor in the data-scan period per row. The second voltage is used to determine the drive current. Furthermore, the step of driving the pixel sub-circuit includes switching the first scan signal to the high voltage in an emission period following the data-scan period per row in each frame of the displaying time during which the drive current drives light emission of the corresponding subpixel.

Optionally, the data-scan period per mw includes a time duration equal to or less than an inverse value of the second scanning rate. Each frame in the displaying time is a sum of all data-scan periods plus a vertical blank time for the display panel to display one frame of image. The displaying time includes one or more frames. The displaying time is followed by another non-displaying time including a second sensing time and a system-resetting time before powering off the display panel. The second sensing time is configured to be substantially similar to the first sensing time for the display panel.

In yet another aspect the present disclosure provides a display apparatus including a display panel having an array of subpixels. Each subpixel is associated with a display-driving circuit described herein.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Conventional two-transistor-one-capacitor circuitry structure for the pixel circuit of the OLED display panel had a drawback of instability in the drive current due to the drift of threshold voltage $V_{th}$ of the driving transistor. Other existing pixel circuit may be able to successfully compensate the $V_{th}$ drift effect on the drive current, but it usually achieved that at an expense of using more complex design in the pixel circuit by using much more transistors such as 6T1C, 7T1C, or 8T2C, etc. As the display panel demands higher display resolution, the effective size of active area of the display panel needs to be made as large as possible under a fixed physical size. This requires usage of less number of signal lines that can be laid out in a narrower border area of the display panel.

Accordingly, the present disclosure provides, inter alia, a display-driving circuit for a subpixel in a display panel, a method for driving a display panel having a plurality of subpixels with each subpixel being associated with the display-driving circuit, and a display apparatus having the same that substantially obviate one or more of the problems due to limitations and disadvantages of the related art. In one aspect, the present disclosure provides a display-driving circuit that can be implemented to drive an OLED in the display panel to emit light for displaying a subpixel image.

Figure 1:
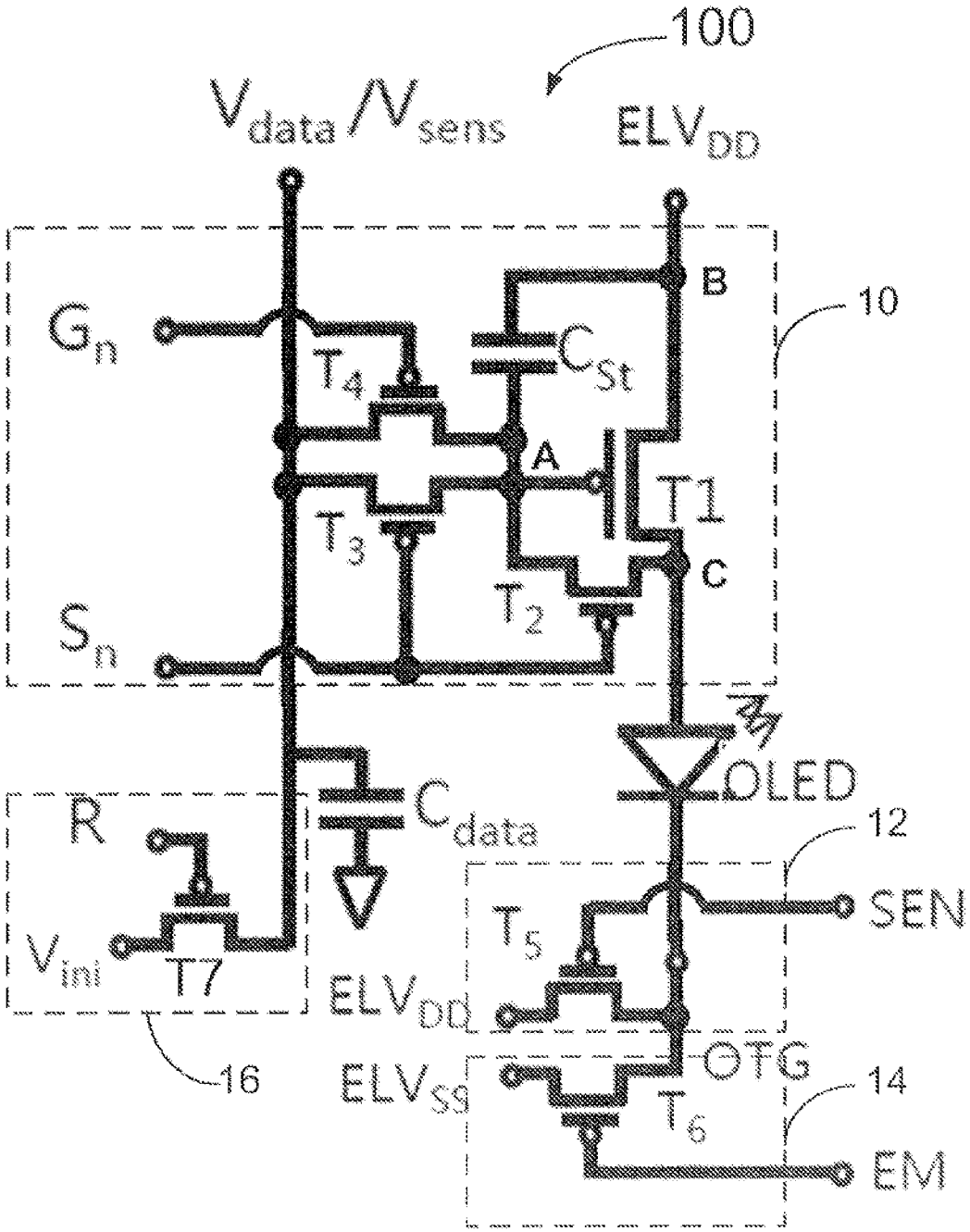
FIG. 1 is a block diagram of a display-driving circuit for a display panel according to an embodiment of the present disclosure.

FIG. 1 is a block diagram of a display-driving circuit for a display panel according to an embodiment of the present disclosure. Referring to FIG. 1, the display-driving circuit 100 includes a pixel sub-circuit 10 and several peripheral sub-circuits including a sensing-control sub-circuit 12, an emission-control sub-circuit 14, and a reset sub-circuit 16. The pixel sub-circuit 10 includes a driving transistor T1, three switch transistors T2, T3, T4, a storage capacitor $C_{st}$, and is configured to couple with a first power-supply line ELVDD, a data-sensing line $V_{data}/V_{sens}$, a first scan line Gn, and a second scan line Sn, respectively, for determining a drive current flowing to a first electrode of a light-emitting device, e.g., an organic light-emitting diode (OLED).

In a specific embodiment, all the transistors in the display-driving circuit are chosen to be p-type PMOS transistors. It is just for the convenience of description, as similar circuitry layout in accordance of proper control signal timing design can still be provided within the same scope if all transistors use n-type NMOS transistors or partially use NMOS and partially use PMOS transistors.

Referring to FIG. 1, the driving transistor T1 of the pixel sub-circuit 10 is connected in series between the first power-supply line ELVDD and the light-emitting device OLED. In particular, the driving transistor T1 has a source electrode coupled to the first power-supply line ELVDD, a drain electrode coupled to a first electrode C of the OLED, and a gate electrode coupled to a node A. A second transistor T2 is laid in the pixel sub-circuit 10 such that a source electrode of T2 is coupled to the node A or the gate electrode of T1, a drain electrode of T2 is coupled to the drain electrode of T1, and a gate electrode of T2 is coupled to the second scan line Sn. A third transistor T3 is configured to have its source electrode coupled to the data-sensing line $V_{data}/V_{sens}$, its drain electrode coupled to the node A. and its gate electrode also coupled to the second scan line Sn. A fourth transistor T4 has its source electrode also coupled to the data-sensing line $V_{data}/V_{sens}$ and its drain electrode also coupled to the node A, but its gate electrode coupled to the first scan line Gn. Additionally, the storage capacitor $C_{st}$ is configured to have its two electrodes respectively coupled to the node A (or the gate electrode of the driving transistor) and the source electrode of the driving transistor. The second transistor T2 and the third transistor T3 are controlled by a second scan signal supplied to the second scan line Sn to allow the charged voltage in the storage capacitor $C_{st}$ to be incorporated into a parasitic capacitor $C_{data}$ associated with the data-sensing line $V_{data}/V_{sens}$ in a sensing time of a non-displaying time for operating the display panel. The fourth transistor T4 is controlled by a first scan signal supplied to the first scan line Gn to allow a data signal to be loaded from the data-sensing line $V_{data}/V_{sens}$ to the node A and store into the storage capacitor $C_{st}$ in a displaying time when the display panel is operated to display image. The pixel sub-circuit 10 is associated with a subpixel disposed in an active area in the display panel. In other words, each subpixel of a plurality of subpixels arranged in a pixel matrix in the active area contains a pixel sub-circuit 10 for driving a light-emitting device OLED to emit light during a displaying time.

In the embodiment, the peripheral sub-circuits are disposed in border area surrounding the active area in the display panel. The sensing-control sub-circuit 12 includes a fifth transistor T5. The fifth transistor T5 is a sensing-control transistor having a source electrode coupled to the first power-supply line ELVDD, a drain electrode coupled to a second electrode OTG of the light-emitting device OLED, and a gate electrode served as a first control terminal SEN to receive a sensing-control signal. The emission-control sub-circuit 14 includes a sixth transistor T6. The sixth transistor T6 is an emission-control transistor having a source electrode coupled to a second power-supply line ELVSS, a drain electrode coupled to the second electrode OTG of the OLED, and a gate electrode served as a second control terminal EM to receive an emission-control signal. The reset sub-circuit 16 includes a seventh transistor T7. The seventh transistor T7 is a reset transistor having a source electrode coupled to an initializing voltage terminal $V_{ini}$, a drain electrode coupled to the data-sensing line $V_{data}/V_{sens}$, and a gate electrode coupled to a reset terminal R to receive a reset signal. Optionally, the first electrode C of the OLED is an anode and the second electrode OTG of the OLED is a cathode.

By controlling the sensing-control signal and the emission-control signal, the display-driving circuit 100 can be configured to operate in a non-displaying mode or a displaying mode depended on where the cathode OTG of the OLED is chosen to connect. In a scenario, when the sensing-control signal SEN is set to a low voltage (or turn-on voltage for PMOS transistor), the fifth transistor T5 is turned on. When the emission-control signal EM is set to a high voltage (or turn-off voltage for PMOS transistor), the sixth transistor T6 is turned off. In this condition, the cathode OTG of the OLED is connected to the first power-supply line ELVDD. The first power-supply line ELVDD is typically supplied with a fixed high voltage $ELV_{DD}$. This makes the light-emitting device OLED be set to a reversed bias mode so that no light is emitting. At the same time, since both ends of the serial connection of T1 and OLED are connected to the first power-supply line ELVDD, there will be no drive current flowing through the OLED, thereby the corresponding sub-pixel is in a no-emission or non-displaying state. During the non-displaying state, the data-sensing line of the pixel sub-circuit 10 associated with the corresponding subpixel can be utilized for a sensing operation to sample a sensing signal $V_{sens}$ that carries information about electrical parameters such as threshold voltage $V_{th}$ or carrier mobility $\mu$ of the driving transistor. In fact, the pixel sub-circuits respectively associated with each row of subpixels can be operated at a same time to perform the sensing operation during one sensing-scan period per row. Further, this sensing operation can be performed in the non-displaying time for all subpixels in entire display panel by progressively scanning one row after another through the display panel with first scanning rate.

In another scenario, when the emission-control signal EM is a low voltage set to the second control terminal, the sixth transistor T6 is turn on so that the cathode OTG of the OLED is connected to the second power-supply line ELVSS. The second power-supply line ELVSS is typically supplied with a fixed low voltage $ELV_{SS}$ or at ground level. At the same time, when the sensing-control signal SEN is a high voltage set to the first control terminal, the fifth transistor T5 is turned off to disconnect the cathode OTG of the OLED from the first power-supply line ELVDD. This sets a condition to allow the OLED to be in a positive bias mode which effectively allows the drive current to flow through and drive the OLED to emit light. Therefore, the corresponding sub-pixel is in a displaying state. In fact, the whole row of subpixels can be all in the displaying state during one data-scan period per row as the whole display panel is progressively scanned through all rows of subpixels in a second scanning rate to display one frame of image after another. Optionally, the second scanning rate is 60 Hz or higher.

For each subpixel, when the pixel sub-circuit performs a sensing operation in a sensing-scan period in the non-displaying time, the sensing signal $V_{sens}$ carrying information about the threshold voltage $V_{th}$ of the driving transistor T1 is sampled via the data-sensing line during the current sensing-scan period. Optionally, the sensing signal $V_{sens}$ is delivered via a driver IC to an external compensation module which is able to calculate the value of $V_{th}$. When the same pixel sub-circuit next performs a displaying operation in a data-scan period in the displaying time after the non-displaying time, the value of $V_{th}$ can be added to an original pixel voltage $V_{pixel}$ by the external compensation module to form a compensated data signal. This compensated data signal then is loaded back to the same data-sensing line and stored into the storage capacitor $C_{st}$ of the pixel sub-circuit. As a result, the drive current determined by the compensated data signal is able to eliminate the drift effect of $V_{th}$ so that the light emission driven by the drive current will be substantially independent from the non-uniformity of image brightness.

Several thin-film transistor (TFT) processes, including amorphous silicon TFT process, low-temperature polycrystalline silicon (LTPS) TFT process, and oxide-semiconductor TFT process, are implemented for the manufacture of the OLED backplane substrate. In particular, the LTPS TFT process has become a main stream of OLED backplane manufacture due to advantages in higher carrier mobility and process stability. Another advantage of the LTPS TFT process lies in a smaller $V_{th}$ drift under stress from environmental change and over prolonged working hours. Accordingly, sampling a $V_{th}$ value for a driving transistor of a subpixel based on LPTS TFT process and applying the sampled $V_{th}$ to the compensated data signal for driving light emission can be performed in two different times, such as sampling the sensing signal $V_{sens}$ in a sensing time in a non-displaying time versus loading the compensated data signal in a separate displaying time.

Figure 2:
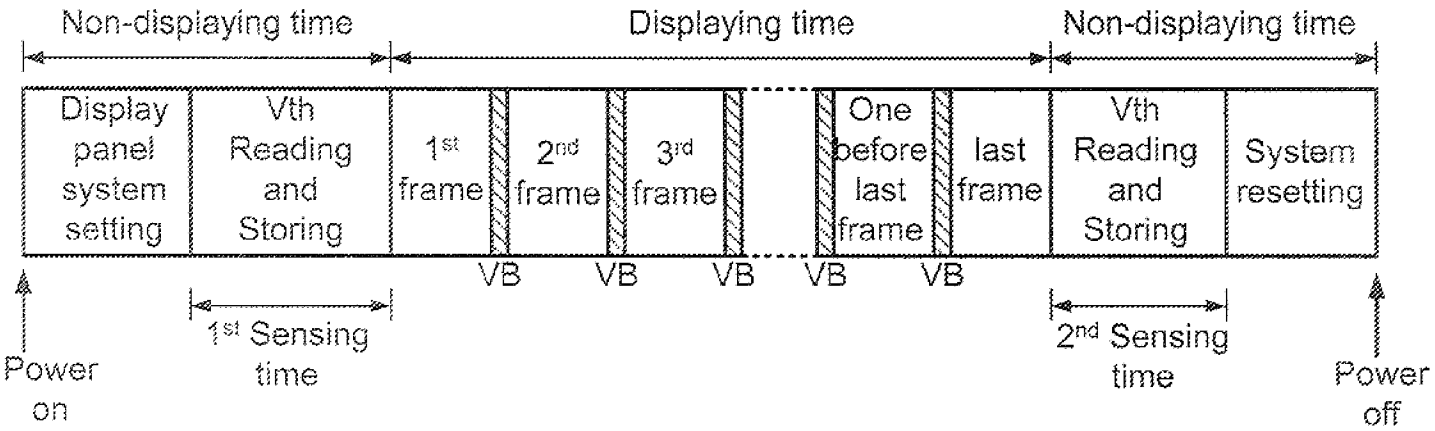
FIG. 2 is a schematic diagram showing a method for driving a display panel for displaying one or more frames of image according to some embodiments of the present disclosure.

FIG. 2 is a schematic diagram showing a method for driving a display panel for displaying one or more frames of image according to some embodiments of the present disclosure. Referring to FIG. 2, the operation of a display-driving circuit associated with a corresponding subpixel is expanded for driving a whole display panel having a plurality of subpixels and each subpixel being associated with the display-driving circuit of the same. The method includes a step of powering on the display panel to provide a power-supply voltage and system shift-register signals to a respective one pixel sub-circuit of a plurality of pixel sub-circuits in a system-setting time of a non-displaying time. Each of the plurality of pixel sub-circuits is constructed with four transistors and one storage capacitor and is associated with a corresponding subpixel having a light-emitting diode. When the display panel is powered on, the power supply of all display-driving circuits and shift-registers in a controller in the display panel need to set various voltages and other electrical parameters during a system-setting time. This time is part of a non-displaying time for the display panel during which no light emission is produced for each subpixel to avoid any abnormity for an image to be displayed.

In the embodiment, as seen in FIG. 2 in view of FIG. 1, the step of powering up the display panel includes providing the power-supply voltage $ELV_{DD}$ to a first power-supply line coupled to a source electrode of a driving transistor T1 in the respective one pixel sub-circuit, the driving transistor having a drain electrode coupled in series to a first electrode of the light-emitting diode OLED.

In the embodiment, as seen in FIG. 2 in view of FIG. 1, the step of powering up the display panel further includes providing a first scan signal $G_n$ based on one of the system shift-register signals to a first scan line coupled to a gate electrode of a fourth transistor T4 in the respective one pixel sub-circuit. The fourth transistor T4 has a source electrode coupled to the data-sensing line and a drain electrode coupled to the gate electrode of the driving transistor T1.

In the embodiment, as seen in FIG. 2 in view of FIG. 1, the step of powering up the display panel further includes providing a second scan signal $S_n$ based on another of the system shift-register signals to a second scan line coupled to gate electrodes of both a second transistor T2 and a third transistor T3 in the respective one pixel sub-circuit. The second transistor T2 has a source electrode coupled to the gate electrode of the driving transistor T1 and a drain electrode coupled to the first electrode of the light-emitting diode OLED. The third transistor T3 having a source electrode coupled to the data-sensing line and a drain electrode coupled to the gate electrode of the driving transistor T1.

Figure 3:
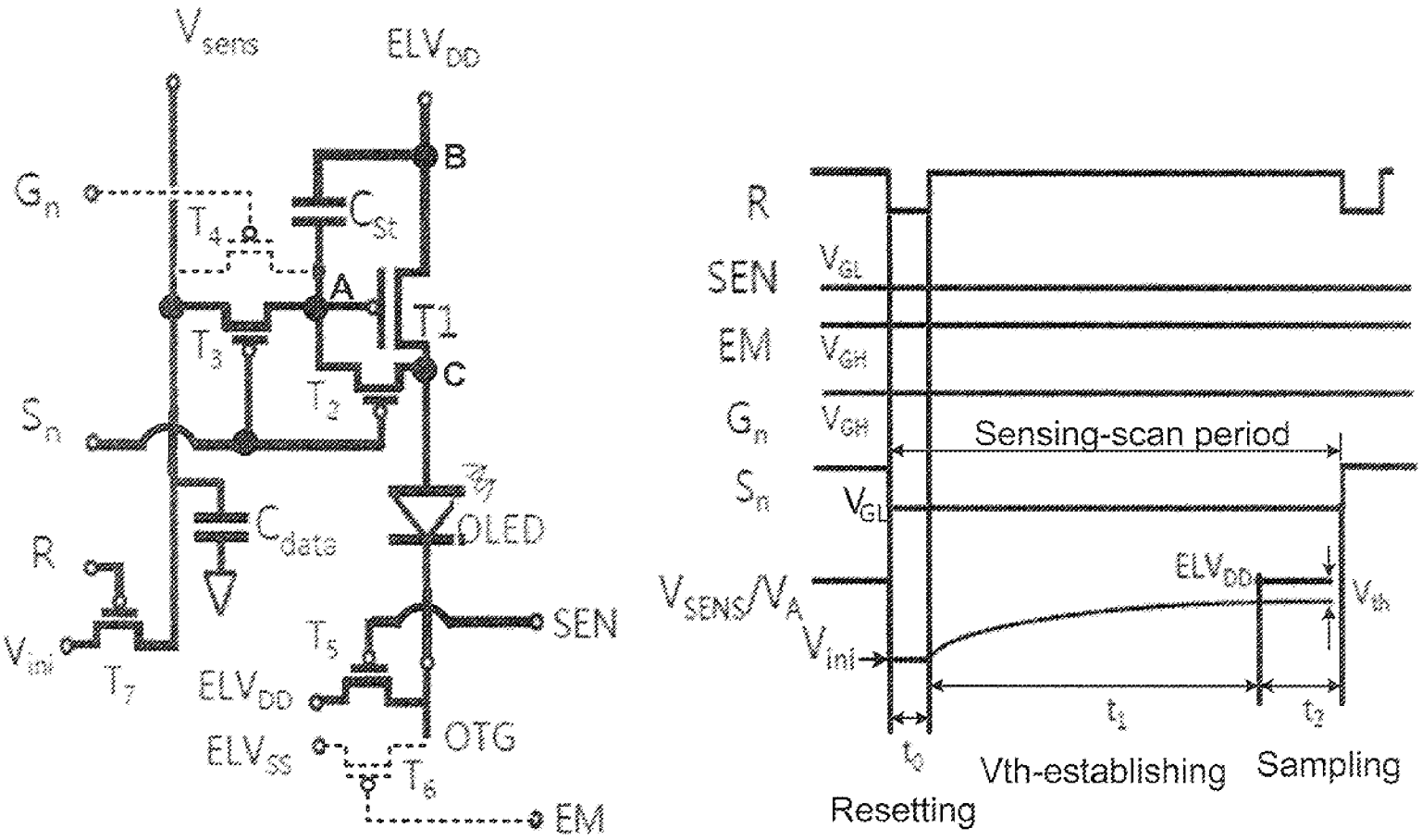
FIG. 3 shows an effective circuitry diagram of the display-driving circuit of FIG. 1 and a corresponding timing diagram of operating the display-driving circuit during a sensing-scan period in a non-displaying time according to an embodiment of the present disclosure.

Referring to FIG. 2, the method additionally includes a step of sampling and storing a sensing signal $V_{sens}$ from a data-sensing line of the respective one pixel sub-circuit in one row of subpixels in a sensing time. Optionally, the method includes programming a first sensing time in between the system-setting time and a displaying time designed normally for the display panel. Optionally, a special timing waveform for several control signals generated by the controller is implemented to drive the display-driving circuit in the first sensing time. FIG. 3 shows an effective circuitry diagram of the display-driving circuit of FIG. 1 and a corresponding timing diagram of operating the display-driving circuit during a sensing-scan period in a non-displaying time according to an embodiment of the present disclosure. To the left side of FIG. 3, the display-driving circuit 100 (FIG. 1) is shown effectively with the fourth transistor T4 in the pixel sub-circuit 10 being disabled and the emission-control sub-circuit 14 being disabled.

Referring to FIG. 2 and FIG. 3, the step of sampling and storing a sensing signal $V_{sens}$ is performed in one sensing-scan period per row of the first sensing time. In the sensing-scan period, for the respective one display-driving circuit 100 in one row of the subpixels being scanned currently, a sensing-control signal at a low voltage $V_{GL}$ is applied to a first control terminal SEN which is a gate electrode of a sensing-control transistor T5 of the sensing-control sub-circuit 12 in the display-driving circuit 100 having its source electrode connected to the first power-supply line ELVDD and its drain electrode connected to a second electrode or cathode OTG of the OLED. The sensing-control transistor T5 (a PMOS transistor) is turned on to connect the cathode of the OLED to the first power-supply line ELVDD. Since the first power-supply line ELVDD is supplied with the power-supply voltage at a fixed high voltage $ELV_{DD}$, this effectively set the OLED to a reversed bias mode to prevent it from emitting light.

Also referring to FIG. 3, an emission-control signal at a high voltage $V_{GH}$ is applied to a second control terminal EM which is a gate electrode of an emission-control transistor T6 of the emission-control sub-circuit 14 in the display-driving circuit 100 having its source electrode coupled to a second power-supply line ELVSS and its drain electrode coupled to the cathode OTG of the OLED. Thus, the emission-control transistor T6 (a PMOS transistor) is turned off to have the cathode OTG of the OLED disconnected from the second power-supply line ELVSS. Effectively, no drive current is flowing through the OLED in this condition, ensuring no light emission in the non-displaying time.

As seen in FIG. 1 and FIG. 3, in the sensing-scan period, a first scan signal $G_n$ for the pixel sub-circuit 10 is also provided at a high voltage $V_{GH}$, so the fourth transistor T4 is turned off. Optionally, the sensing-scan period is divided into several sub-periods. At a beginning of the sensing-scan period per row, it includes firstly a resetting sub-period t0. During this sub-period t0, a second scan signal $S_n$ and a reset signal R are set to a low voltage $V_{GL}$. A reset transistor T7 of the reset sub-circuit 16, which has a source electrode coupled to an initializing voltage terminal and a drain electrode coupled to the data-sensing line, is turned on by the reset signal R to allow the data-sensing line be reset to the initializing voltage $V_{ini}$. Optionally, the initializing voltage $V_{ini}$ is fixed at a level smaller than the power-supply voltage $ELV_{DD}$ minus a threshold voltage $V_{th}$ of a driving transistor T1 in the pixel sub-circuit 10 of the display-driving circuit 100. A second transistor T2 and a third transistor T3 are turned on by the second scan signal $S_n$ to allow the initializing voltage $V_{ini}$ to be written into the storage capacitor $C_{st}$ and the gate electrode of the driving transistor T1 in the pixel sub-circuit 10. Since $V_{ini}<ELV_{DD}-V_{th}$, the driving transistor T1 is in ON state.

Next in a $V_{th}$-establishing sub-period t1 in the sensing-scan period, the reset signal R becomes a high voltage and the second scan signal $S_n$ remains at the low voltage so that the reset transistor T7 is turned off, and the second transistor T2 and the third transistor T3 are kept in ON state. The driving transistor T1 and the second transistor T2 together allow a charging effect from the first power-supply line ELVDD to the storage capacitor $C_{st}$ and further to a parasitic capacitor $C_{data}$ of the data-sensing line through the third transistor T3. Voltage levels in the data-sensing line and the storage capacitor $C_{st}$ start to rise from the initializing voltage $V_{ini}$ due to the charging effect. As the voltage levels in the $C_{data}$ and the $C_{st}$ rise, a gate-to-source voltage $V_{gs}$ of the driving transistor T1 reduces. Given a long enough time (of the $V_{th}$-establishing sub-period), the $V_{gs}$ is reduced to $V_{th}$ and the driving transistor T1 is turned to OFF state. At this time, e.g., an end of the $V_{th}$-establishing sub-period t1, the voltage levels at the $C_{data}$ and $C_{st}$ are saturated to a first voltage=$ELV_{DD}-V_{th}$.

As the charging effect to $C_{data}$ and $C_{st}$ reaches saturation, the sensing-scan period includes a sampling sub-period t2 in which the first voltage $ELV_{DD}-V_{th}$ is sampled as a sensing signal $V_{sens}$ read from the data-sensing line. Optionally, this sensing signal is sent via a driver IC to an external compensation module in the controller (not shown) where the threshold voltage $V_{th}$ is read and stored in a memory thereof.

In the embodiment, the step performed in one sensing-scan period per row is further expanded to the entire display panel when every row of subpixels in the display panel is scanned progressively with a first scanning rate. Referring to FIG. 2 and FIG. 3, in one sensing-scan period, every subpixel in the current row being scanned is subjected to the sampling of one sensing signal $V_{sens}$ via one data-sensing line of the respective one pixel sub-circuit. The sensing signal $V_{sens}$ carries information of a threshold voltage $V_{th}$ of a driving transistor in the corresponding subpixel. The threshold voltage $V_{th}$ is then read out from the sensing signal $V_{sens}$ by an external compensation module in the controller and stored in a memory thereof Δt an end of the sensing time that is summed over all sensing-scan periods for all rows of subpixels, the $V_{th}$ of every subpixel in the entire display panel is sampled and stored in respective one external compensation module in the controller.

Optionally, the timing setting for scanning through the entire display panel in the sensing time can be programmed in the controller to at least with an aim to make the $V_{th}$-establishing sub-period long enough to allow the charging effect to reach its saturation. This can be achieved by reducing the first scanning rate to reduce sensing-scan frequency and enlarge the sensing-scan period. Optionally, the first scanning rate is reduced to 10 Hz, or even 1 Hz. Thus, at each subpixel there is enough time to write the $V_{th}$ into the storage capacitor $C_{st}$ and the parasitic capacitor $C_{data}$ of the data-sensing line, ensuring the sensing signal $V_{sens}$ carrying an accurate information of the $V_{th}$.

Figure 1A:
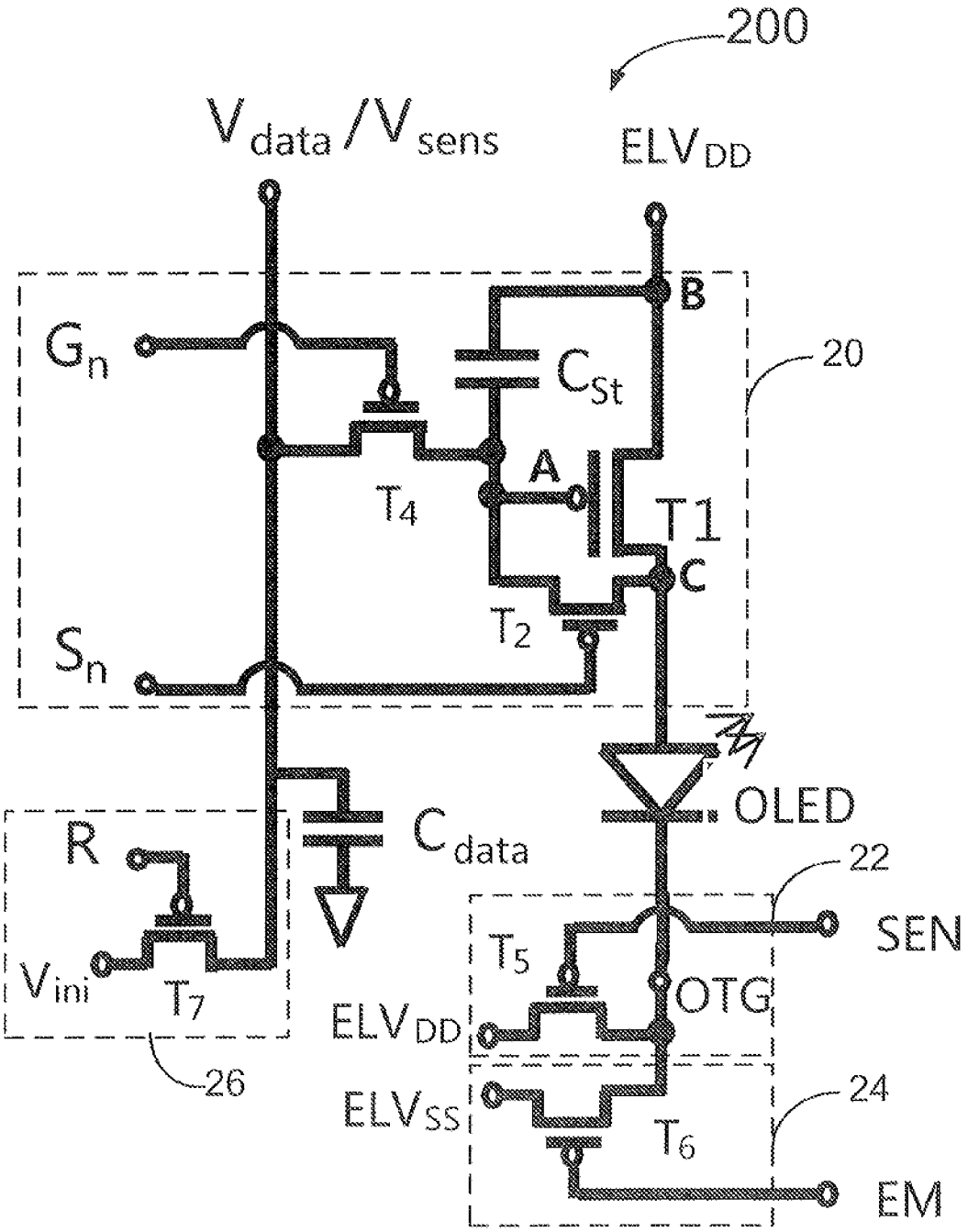
FIG. 1A is a block diagram of a display-driving circuit for a display panel according to another embodiment of the present disclosure.

FIG. 1A is a block diagram of a display-driving circuit for a display panel according to another embodiment of the present disclosure. Referring to FIG. 1A, the display-driving circuit 200 includes a pixel sub-circuit 20 and several peripheral sub-circuits including a sensing-control sub-circuit 22, an emission-control sub-circuit 24, and a reset sub-circuit 26. The pixel sub-circuit 20 includes a driving transistor T1, two switch transistors T2 and T4, a storage capacitor $C_{st}$, and is configured to couple with a first power-supply line ELVDD, a data-sensing line $V_{data}/V_{sens}$, a first scan line Gn, and a second scan line Sn, respectively, for determining a drive current flowing to a first electrode of a light-emitting device, e.g., an organic light-emitting diode (OLED). Optionally, all transistors in the display-driving circuit 200 are p-type transistors. The display-driving circuit 200 is substantially similar to the display-driving circuit 100 except that the third transistor T3 is no longer needed.

By applying the sensing-control signal to the first control terminal SEN for controlling the sensing-control sub-circuit 22 and the emission-control signal to the second control terminal EM for controlling the emission-control sub-circuit 24, the display-driving circuit 200 can be configured to operate in a non-displaying mode or a displaying mode depended on where the cathode OTG of the OLED is chosen to connect. In a scenario, when the sensing-control signal SEN is set to a low voltage (or turn-on voltage for PMOS transistor), the fifth transistor T5 is turned on. When the emission-control signal EM is set to a high voltage (or turn-off voltage for PMOS transistor), the sixth transistor T6 is turned off. In this condition, the cathode OTG of the OLED is connected to the first power-supply line ELVDD supplied with a fixed high voltage $ELV_{DD}$. This makes the light-emitting device OLED be set to a reversed bias mode so that no light is emitting. At the same time, since both ends of the serial connection of T1 and OLED are connected to the first power-supply line ELVDD, there will be no drive current flowing through the OLED, thereby the corresponding subpixel is in a no-emission or non-displaying state. During the non-displaying state, the data-sensing line of the pixel sub-circuit 20 associated with the corresponding subpixel can be utilized for a sensing operation including at least a sampling step to obtain a sensing signal $V_{sens}$ that carries information about electrical parameters such as threshold voltage $V_{th}$ or carrier mobility p of the driving transistor and a storing step to save the sampled sensing signal $V_{sens}$ to the memory of a compensation module. In fact, the pixel sub-circuits 20 respectively associated with each row of subpixels can be operated at a same time to perform the sensing operation during one sensing-scan period per row. Further, this sensing operation can be performed in the non-displaying time for all subpixels in entire display panel by progressively scanning one row after another through the display panel with first scanning rate.

In another scenario, when the emission-control signal EM is a low voltage set to the second control terminal EM, the sixth transistor T6 of the emission-control sub-circuit 24 is turn on so that the cathode OTG of the OLED is connected to the second power-supply line ELVSS supplied with a fixed low voltage $ELV_{SS}$ or at ground level. At the same time, when the sensing-control signal SEN is a high voltage set to the first control terminal SEN, the fifth transistor T5 of the sensing-control sub-circuit 22 is turned off to disconnect the cathode OTG from the first power-supply line ELVDD. This sets a condition to allow the OLED to be in a positive bias mode which effectively allows the drive current to flow through and drive the OLED to emit light. Therefore, the corresponding subpixel is in a displaying state. In fact, the whole row of subpixels can be all in the displaying state during one data-scan period per row as the whole display panel is progressively scanned through all rows of subpixels in a second scanning rate to display one frame of image after another. Optionally, the second scanning rate is 60 Hz or higher.

Figure 3A:
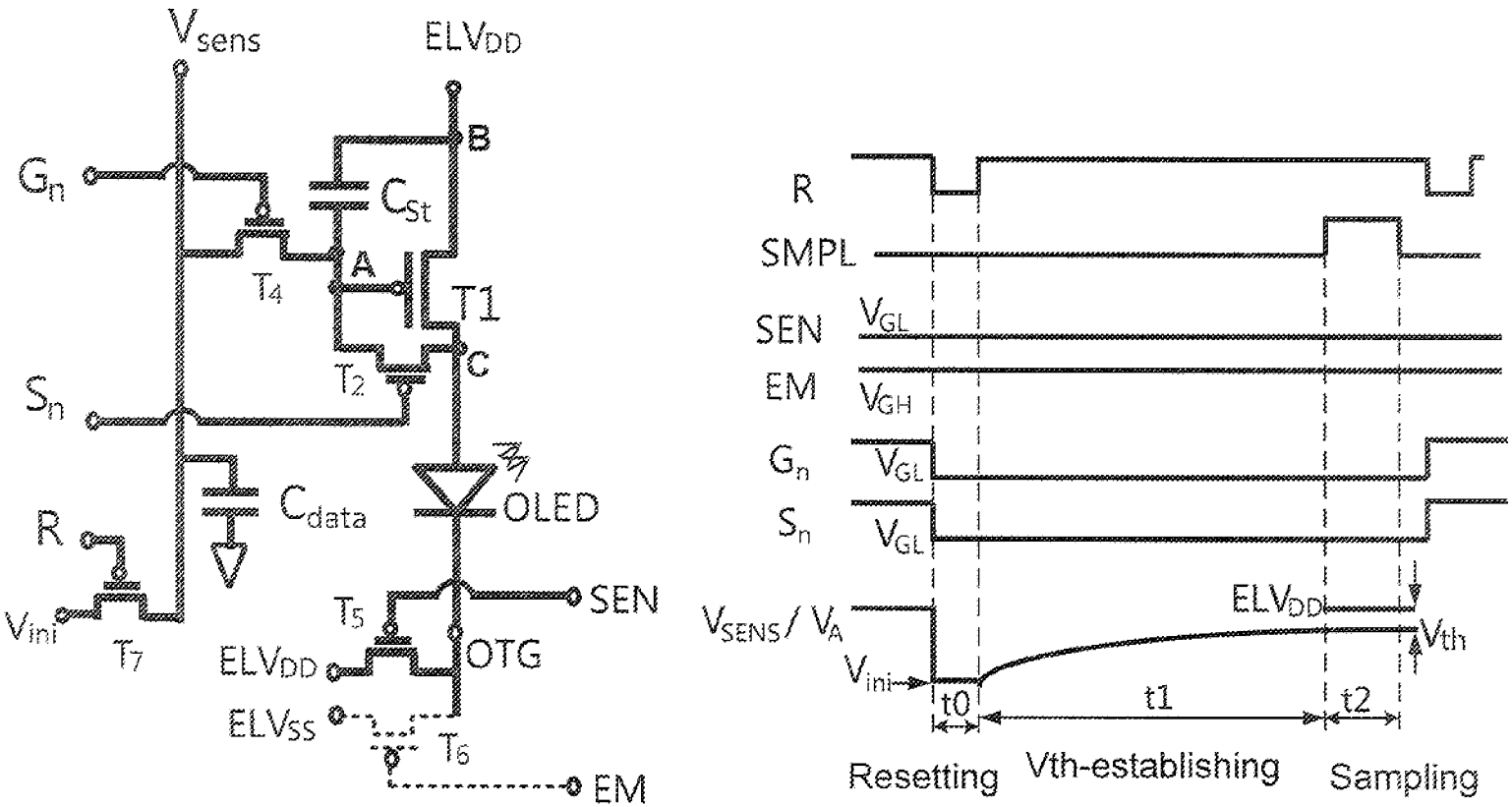
FIG. 3A shows an effective circuitry diagram of the display-driving circuit of FIG. 1A and a corresponding timing diagram during a sensing-scan period in a non-displaying time according to another embodiment of the present disclosure.

FIG. 3A shows an effective circuitry diagram of the display-driving circuit of FIG. 1A and a corresponding timing diagram during a sensing-scan period in a non-displaying time according to another embodiment of the present disclosure. To the left side of FIG. 3A, the display-driving circuit 200 is shown with the emission-control sub-circuit 24 being effectively disabled. Referring to FIG. 2 and FIG. 3A, the steps of sampling and storing a sensing signal $V_{sens}$ is performed in one sensing-scan period per row of the first sensing time. In the sensing-scan period, for the respective one display-driving circuit 200 in one row of subpixels being scanned currently, a sensing-control signal at a low voltage $V_{GL}$ is applied to a first control terminal SEN which is a gate electrode of a sensing-control transistor T5 of the sensing-control sub-circuit 22 in the display-driving circuit 200 having its source electrode connected to the first power-supply line ELVDD and its drain electrode connected to a second electrode or cathode OTG of the OLED. The sensing-control transistor T5 (a PMOS transistor) is turned on to connect the cathode of the OLED to the first power-supply line ELVDD. Since the first power-supply line ELVDD is supplied with the power-supply voltage at a fixed high voltage $ELV_{DD}$, this effectively set the OLED to a reversed bias mode to prevent it from emitting light.

Also referring to FIG. 3A, an emission-control signal at a high voltage $V_{GH}$ is applied to a second control terminal EM which is a gate electrode of an emission-control transistor T6 of the emission-control sub-circuit 24 in the display-driving circuit 200 having its source electrode coupled to a second power-supply line ELVSS and its drain electrode coupled to the cathode OTG of the OLED. Thus, the emission-control transistor T6 (a PMOS transistor) is turned off to have the cathode OTG of the OLED disconnected from the second power-supply line ELVSS. Effectively, no drive current is flowing through the OLED in this condition, ensuring no light emission in the non-displaying time.

As seen in FIG. 1A and FIG. 3A, in the sensing-scan period, a first scan signal $G_n$ for the pixel sub-circuit 20 is also provided at a low voltage $V_{GL}$, so the fourth transistor T4 is turned on to connect the gate electrode A of the driving transistor T1 to the data-sensing line. Optionally, the sensing-scan period is divided into several sub-periods. At a beginning of the sensing-scan period per row, it includes firstly a resetting sub-period t. During this sub-period t0, a second scan signal $S_n$ and a reset signal R are set to a low voltage $V_{GL}$. A reset transistor T7 of the reset sub-circuit 26, which has a source electrode coupled to an initializing voltage terminal supplied with a fixed voltage $V_{ini}$ and a drain electrode coupled to the data-sensing line, is turned on by the reset signal R to allow the data-sensing line be reset to the initializing voltage $V_{ini}$. Optionally, the initializing voltage $V_{ini}$ is fixed at a level smaller than the power-supply voltage $ELV_{DD}$ minus a threshold voltage $V_{th}$ of a driving transistor T1 in the pixel sub-circuit 20 of the display-driving circuit 200. A second transistor T2 of the pixel sub-circuit 20 is turned on also by the second scan signal $S_n$ to allow the initializing voltage $V_{ini}$ to be written into the storage capacitor $C_{st}$ and the gate electrode of the driving transistor T1 in the pixel sub-circuit 20. Since $V_{ini}<ELV_{DD}-V_{th}$, the driving transistor T1 is in ON state.

Next in a $V_{th}$-establishing sub-period t1 in the sensing-scan period, the reset signal R becomes a high voltage and the second scan signal $S_n$ remains at the low voltage so that the reset transistor T7 is turned off, and the second transistor T2 is kept in ON state. The driving transistor T1 and the second transistor T2 together allow a charging effect from the first power-supply line ELVDD to the storage capacitor $C_{st}$ and further to a parasitic capacitor $C_{data}$ of the data-sensing line through the fourth transistor T4. Voltage levels in the data-sensing line and the storage capacitor $C_{st}$ start to rise from the initializing voltage $V_{ini}$ due to the charging effect. As the voltage levels in the $C_{data}$ and the $C_{st}$ rise, a gate-to-source voltage $V_{gs}$ of the driving transistor T1 reduces. Given a long enough time (of the $V_{th}$-establishing sub-period), the $V_{gs}$ is reduced to $V_{th}$ and the driving transistor T1 is turned to OFF state. At this time, e.g., an end of the $V_{th}$-establishing sub-period t1, the voltage levels at the $C_{data}$ and $C_{st}$ are saturated to a first voltage=$ELV_{DD}-V_{th}$.

As the charging effect to $C_{data}$ and $C_{st}$ reaches saturation, the sensing-scan period includes a sampling sub-period t2 in which the first voltage ($ELV_{DD}-V_{th}$) is sampled as a sensing signal $V_{sens}$ read from the data-sensing line. Optionally, this sensing signal $V_{sens}$ is sent via a driver IC to an external compensation module in the controller (not shown) where the threshold voltage $V_{th}$ is read and stored in a memory thereof.

Figure 4:
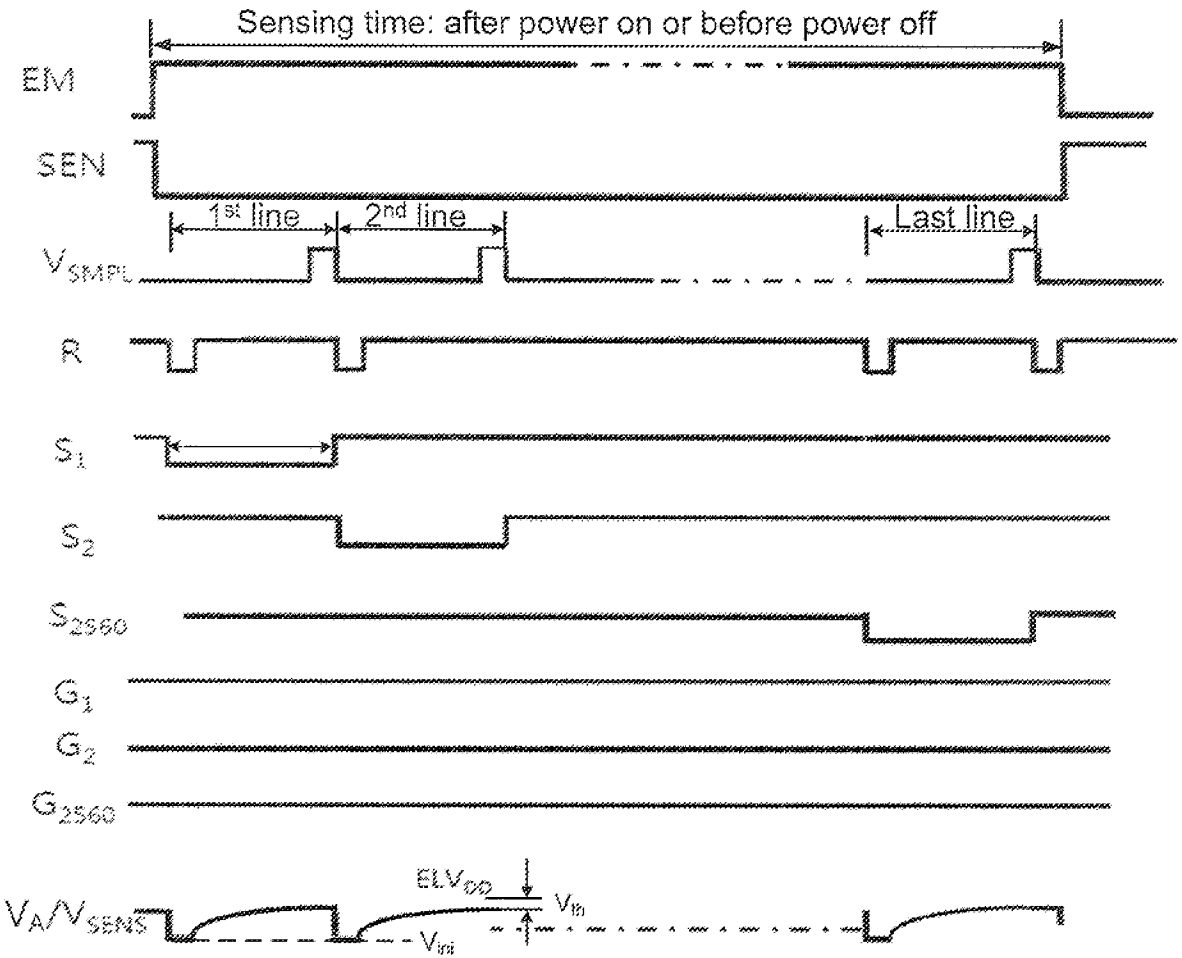
FIG. 4 is an exemplary timing diagram of scanning through the display panel in a first scanning rate during a sensing time according to an embodiment of the present disclosure.

FIG. 4 is an exemplary timing diagram of scanning through the display panel in a first scanning rate during a sensing time according to the embodiment of the present disclosure. Referring to FIG. 4, the timing waveforms of various control signals are set in multiple sensing-scan periods per row in one frame of sensing time for scanning all rows in the display panel, e.g., a display panel with QHD 1440×2560 pixels. In the frame of sensing time, the emission-control signal EM is given a high voltage and the sensing-control signal SEN is given a low voltage for every sensing-scan period per row. In an embodiment in which each pixel in every row of the display panel is provided with a pixel sub-circuit 10 of FIG. 1, the first scan signal for every row, $G_1$ through $G_{2560}$, is given a high voltage to shut off the fourth transistor T4 in each sensing scan period (or in entire frame of sensing time for the display panel) as the data-sensing line is not used for data loading. The second scan signal for every row, $S_1$ through $S_{2560}$, is given a low voltage pulse with a pulse width equal to the respective sensing-scan period to allow the respective one display-driving circuit to execute the sensing function therein so that respective data-sensing line can be charged from the initializing voltage level to the first voltage equal to the power-supply voltage $ELV_{DD}$ minus a $V_{th}$ for the driving transistor in the respective row being scanned in each sensing-scan period. In another embodiment in which each pixel in every row of the display panel is provided with a pixel sub-circuit 20 of FIG. 1A, the first scan signal for every row, $G_1$ through $G_{2560}$, is given a low voltage to turn the fourth transistor T4 on in each sensing scan period. The second scan signal for every row, $S_1$ through $S_{2560}$, is still given a low voltage pulse with a pulse width equal to the respective sensing-scan period to allow the respective one display-driving circuit to execute the sensing function therein so that respective data-sensing line can be charged from the initializing voltage level to the first voltage equal to the power-supply voltage $ELV_{DD}$ minus a $V_{th}$ for the driving transistor in the respective row being scanned in each sensing-scan period. A reset signal R is given at a low voltage (a turn-on voltage for the reset transistor) in every resetting sub-period performed at a beginning of each sensing-scan period for resetting the voltage at the respective one data-sensing line and returned to a high voltage in remaining sub-periods in each sensing-scan period. In an example, the resetting sub-period takes only 6 μs out of about 320 μs in each sensing-scan period for 1 s given in the sensing time. Optionally, a $V_{SMPL}$ control signal is given a high voltage for an internal driver IC to control an analog-to-digital convertor for sampling the sensing signal $V_{sens}$ from the data-sensing line in the sampling sub-period of each sensing-scan period.

Referring to FIG. 2 again, the method furthermore includes a step of driving the respective one pixel sub-circuit (of FIG. 1 or FIG. 1A) to determine a drive current flowing to the light-emitting diode to drive light emission for displaying a subpixel image based on a corresponding data signal loaded to the data-sensing line of the respective one pixel sub-circuit. Optionally, this step is automatically expanded to the whole display panel by sequentially scanning one row after another through all rows with a second scanning rate in each frame of a displaying time following the non-displaying time. Each frame of the displaying time is essentially a time duration for the display panel to display one frame of image by progressively scanning one row after another to load corresponding data signals to the display-driving circuits associated with the corresponding subpixels in the respective rows. Each data-scan period per row is a time duration to load a data signal to the subpixel in one row currently being scanned. One frame is a sum of all data-scan periods for scanning from a first row to a last row in the display panel. The corresponding data signal for each corresponding subpixel is compensated based on the sensing signal $V_{sens}$ sampled for the same subpixel in the first sensing time of the non-displaying time before the displaying time. Additionally, in the displaying time between any two neighboring frames there is a vertical blank time V-blank being added to allow some data buffer time from one frame to another. Further, after the displaying time, the method of driving the display panel may includes another non-displaying time starting at the end of last frame of the displaying time. Optionally, the non-displaying time after the last frame includes a second sensing time followed by a system-resetting time before powering off the display panel. The second sensing time is configured to be substantially similar to the first sensing time for the display panel.

Figure 5:
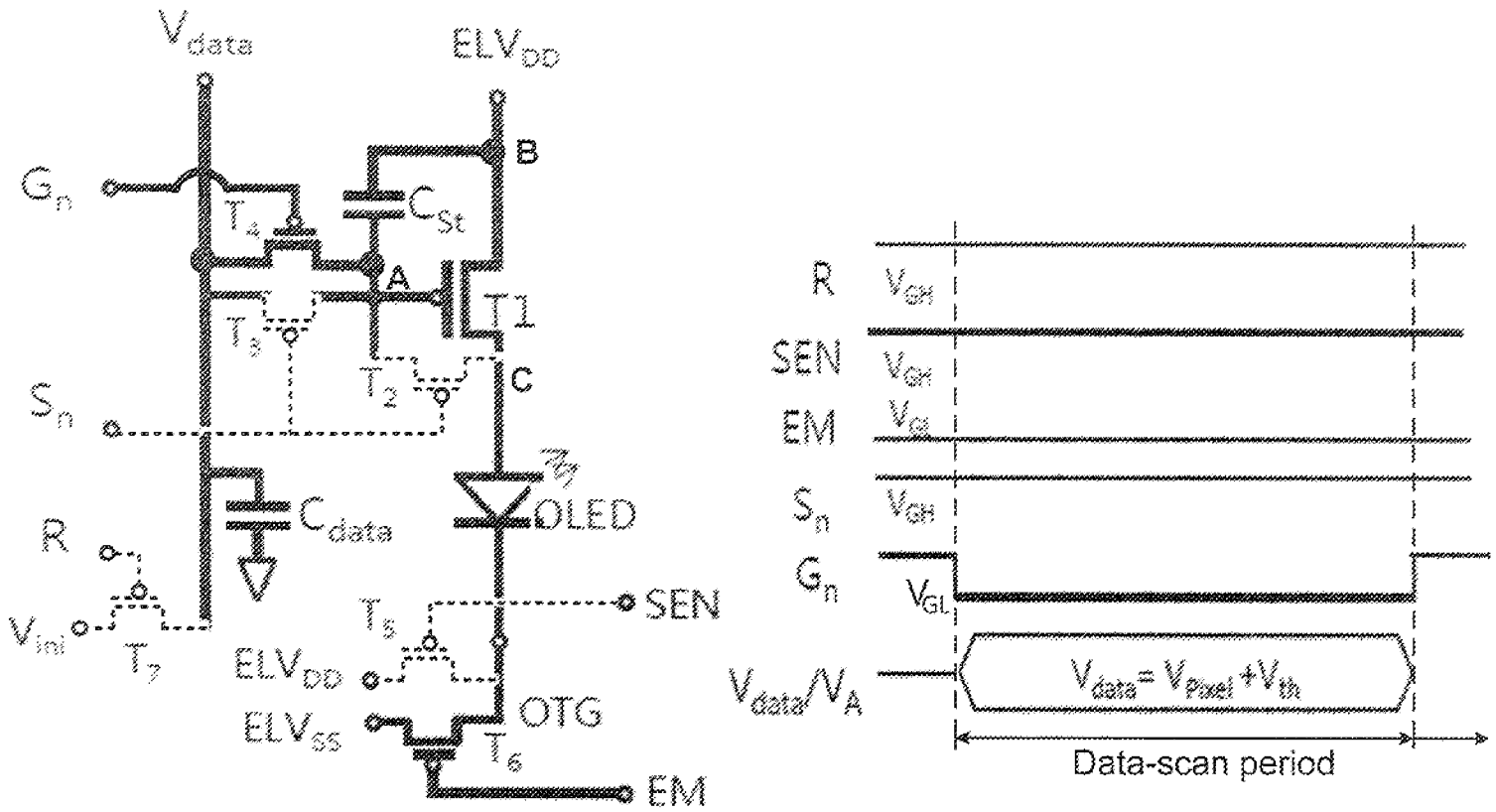
FIG. 5 shows an effective circuitry diagram of the display-driving circuit of FIG. 1 and a corresponding timing diagram of operating the display-driving circuit during a data-scan period in a displaying time according to an embodiment of the present disclosure.

For each data-scan period, each display-driving circuit is operated under control of multiple control signals with a normal timing waveforms. FIG. 5 shows an effective circuitry diagram of the display-driving circuit of FIG. 1 and a corresponding timing diagram of operating the display-driving circuit during a data-scan period in a displaying time according to an embodiment of the present disclosure. Referring to FIG. 5, in the data-scan period, the reset signal R, the sensing-control signal SEN, and the second scan signal $S_n$ are all provided with high voltage $V_{GH}$ to turn off the reset transistor T7, the sensing-control transistor T5, and both the second transistor T2 and the third transistor T3, respectively. The emission-control signal EM is provided with a low voltage $V_{GL}$ to turn on the emission-control transistor T6 to allow the cathode OTG of the OLED to connect to the second power-supply line ELVSS which is typically given a fixed low voltage $ELV_{SS}$ or grounded. This ensures the OLED in a positive bias mode, e.g., with a voltage level at the cathode of the OLED being lower than that at the anode of the OLED. The OLED is able to emit light when the drive current from the driving transistor T1 flows through it after the data signal is loaded and stored into the storage capacitor $C_{st}$.

Referring to FIG. 5, the first scan signal $G_n$ is provided at a low voltage $V_{GL}$ in each data-scan period to allow the data signal $V_{data}$ to be written through the fourth transistor T4 into the node A, i.e., $V_A=V_{data}$. The node A is also a gate electrode of the driving transistor T1 and one terminal of the storage capacitor $C_{st}$. Another terminal of the storage capacitor $C_{st}$ is coupled to the first power-supply line ELVDD which is also the source electrode of the driving transistor T1. Therefore, the gate-to-source voltage of the driving transistor T1 is $V_{gs}=V_{data}-ELV_{DD}$. When the first scan signal $G_n$ is a high voltage, the fourth transistor T4 is turned off. But the voltage stored in $C_{st}$ will be maintained $ELV_{DD}-V_{th}$ which keeps the driving transistor T1 at a saturate state to allow the drive current $I_D$ to be expressed as:

$$I_D=\tfrac{1}{2}\cdot\mu\cdot C_{OX}\cdot W/L\cdot(V_{gs}-V_{th})^2=\tfrac{1}{2}\cdot\mu\cdot C_{OX}\cdot W/L\cdot(V_{data}-ELV_{DD}-V_{th})^2,$$

where μ is a carrier mobility constant, $C_{OX}$ is capacitance associated with oxide layer in the driving transistor T1, W and L are respective width and length of the driving transistor T1.

Since the $V_{th}$ value of the driving transistor has been sampled before and stored in memory, the data signal loaded during the data-scan period has included the $V_{th}$ on top of an original pixel voltage, i.e., $V_{data}=V_{pixel}+V_{th}$. Therefore, $$I_D=\tfrac{1}{2}\cdot\mu\cdot C_{OX}\cdot W/L\cdot(V_{pixel}-ELV_{DD})^2.$$

As seen from above formula, the $V_{th}$ of the driving transistor T1 has been compensated so that the drive current $I_D$ is independent of the value of $V_{th}$. Accordingly, the OLED associated with each subpixel is driven by this drive current to emit light in remaining portion of one frame after each data-scan period.

Figure 5A:
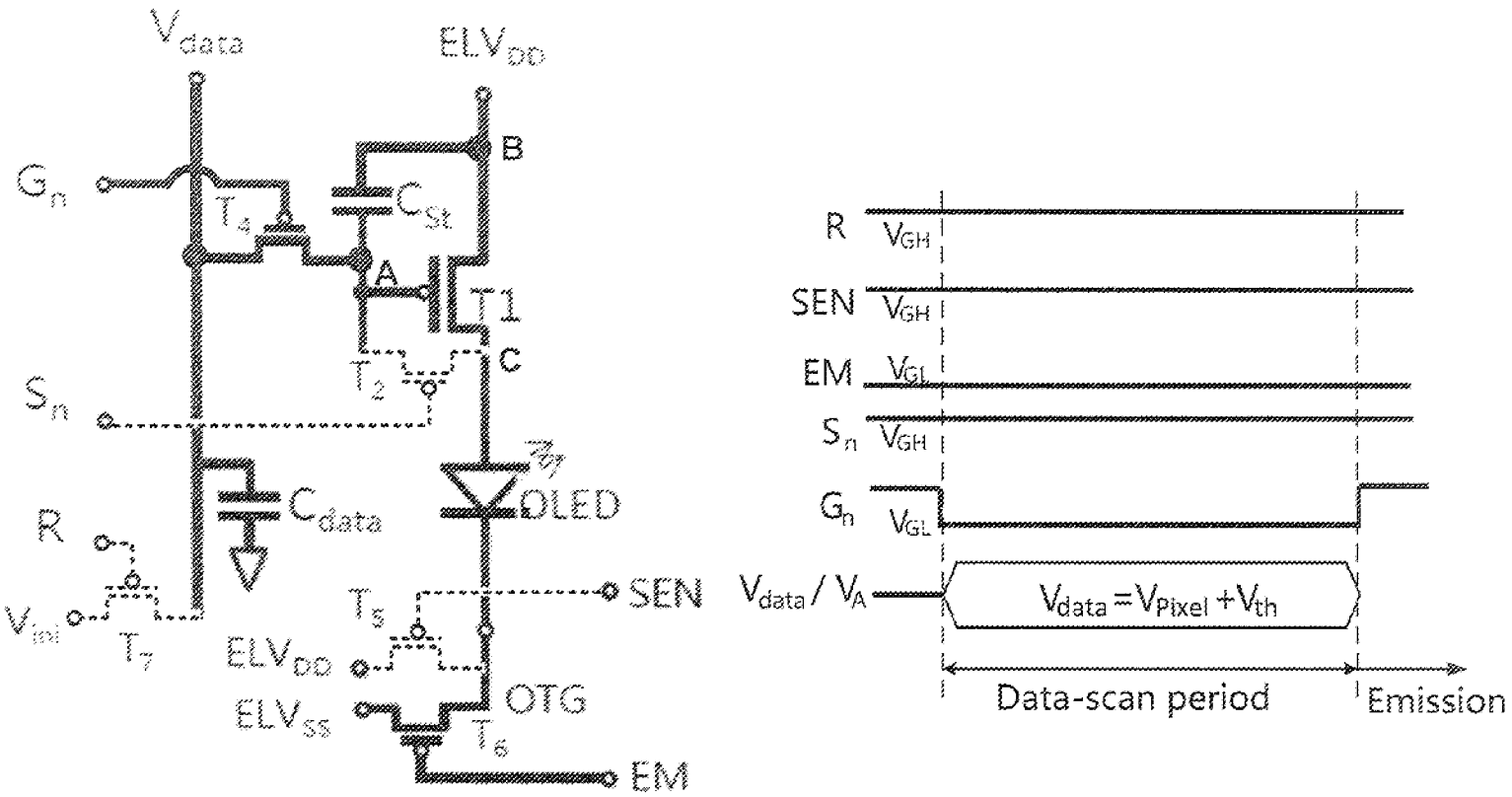
FIG. 5A shows an effective circuitry diagram of the display-driving circuit of FIG. 1A and a corresponding timing diagram during a data-scan period in a displaying time according to another embodiment of the present disclosure.

FIG. 5A shows an effective circuitry diagram of the display-driving circuit of FIG. 1A and a corresponding timing diagram of operating the display-driving circuit during a data-scan period in a displaying time according to an embodiment of the present disclosure. Referring to FIG. 5A, in the data-scan period, the reset signal R, the sensing-control signal SEN, and the second scan signal $S_n$ are all provided with high voltage $V_{GH}$ to turn off the reset transistor T7, the sensing-control transistor T5, and the second transistor T2, respectively. The emission-control signal EM is provided with a low voltage $V_{GL}$ to turn on the emission-control transistor T6 to allow the cathode OTG of the OLED to connect to the second power-supply line ELVSS which is typically given a fixed low voltage $ELV_{SS}$ or grounded. This ensures the OLED in a positive bias mode, e.g., with a voltage level at the cathode of the OLED being lower than that at the anode of the OLED. The OLED is able to emit light when the drive current from the driving transistor T1 flows through it after the data signal is loaded and stored into the storage capacitor $C_{st}$.

Referring to FIG. 5A, the first scan signal $G_n$ is provided at a low voltage $V_{GL}$ in each data-scan period to allow the data signal $V_{data}$ to be written through the fourth transistor T4 into the node A, i.e., $V_A=V_{data}$. The node A is also a gate electrode of the driving transistor T1 and one terminal of the storage capacitor $C_{st}$. Another terminal of the storage capacitor $C_{st}$ is coupled to the first power-supply line ELVDD which is also the source electrode of the driving transistor T1. Therefore, the gate-to-source voltage of the driving transistor T1 is $V_{gs}=V_{data}-ELV_{DD}$. When the first scan signal $G_n$ becomes a high voltage again, the fourth transistor T4 is turned off. But the voltage stored in $C_{st}$ will be maintained at $ELV_{DD}-V_{th}$ which keeps the driving transistor T1 at a saturate state to allow the drive current $I_D$ to be expressed as:

$$I_D=\tfrac{1}{2}\cdot\mu\cdot C_{OX}\cdot W/L\cdot(V_{gs}-V_{th})^2=\tfrac{1}{2}\cdot\mu\cdot C_{OX}\cdot W/L\cdot(V_{data}-ELV_{DD}-V_{th})^2.$$

Since the $V_{th}$ value of the driving transistor has been sampled before and stored in memory, the data signal loaded during the data-scan period has included the $V_{th}$ on top of an original pixel voltage, i.e., $V_{data}=V_{pixel}+V_{th}$. Therefore, $$I_D=\tfrac{1}{2}\cdot\mu\cdot C_{OX}\cdot W/L\cdot(V_{pixel}-ELV_{DD})^2.$$

As seen from above formula, the $V_{th}$ of the driving transistor T1 has been compensated so that the drive current $I_D$ is independent of the value of $V_{th}$. Accordingly, the OLED associated with each subpixel is driven by this drive current to emit light in remaining portion of one frame after each data-scan period.

Figure 6:
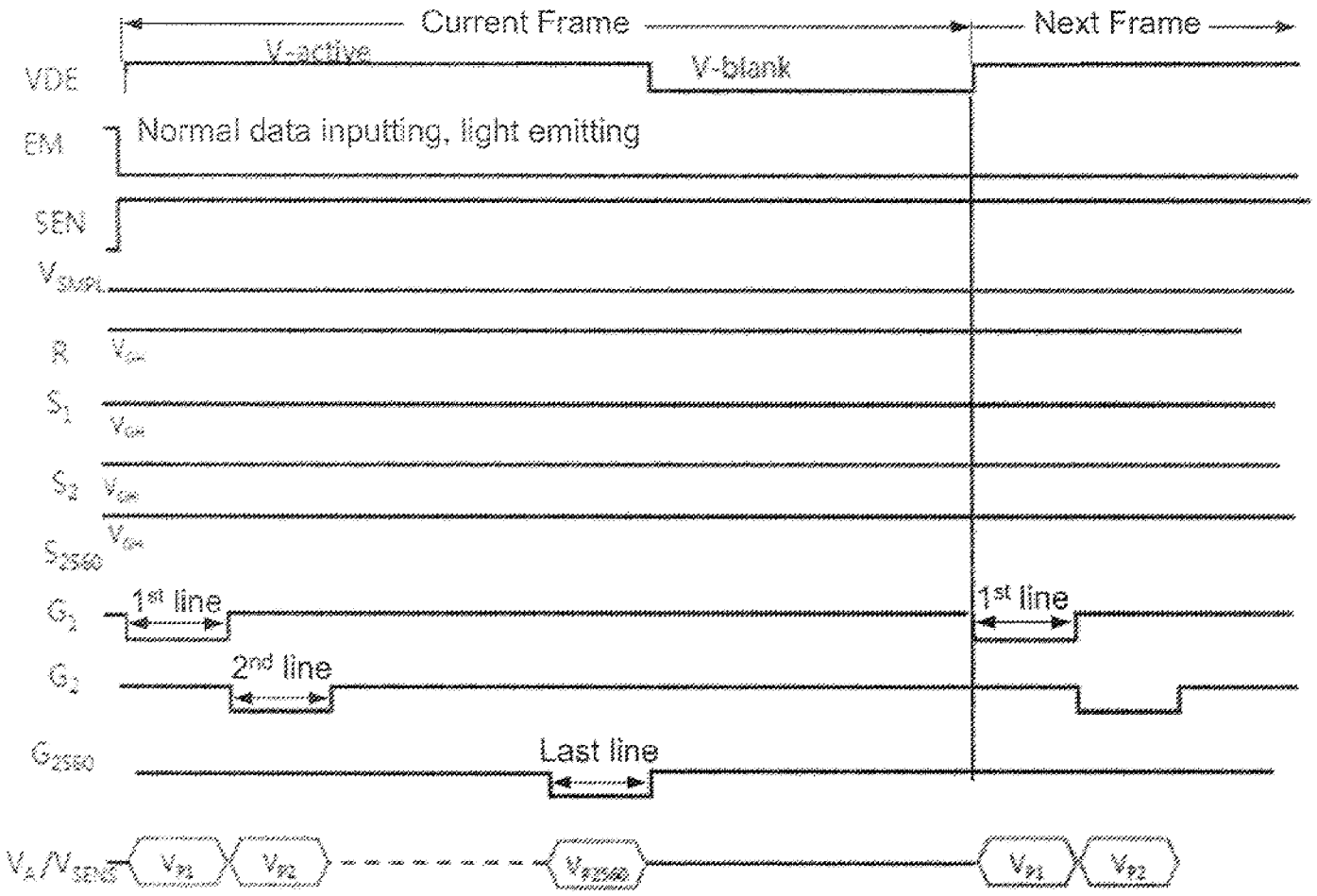
FIG. 6 is an exemplary timing diagram of scanning through the display panel in a second scanning rate during one frame of the displaying time according to the embodiment of the present disclosure.

FIG. 6 is an exemplary timing diagram of scanning through the display panel in a second scanning rate during one frame of the displaying time according to the embodiment of the present disclosure. Referring to FIG. 6, the step of performing the data-scan per row (FIG. 5 or FIG. 5A) is expanded to all rows in one frame by scanning one row after another through all rows of the whole display panel. In this example, the display panel contains 2560 rows of pixels. One frame is a time duration of scanning in a second scanning rate through the 2560 rows of the display panel with each row being scanned at least in one data-scan period. Optionally, the second scanning rate is configured to be a normal refresh rate for displaying one frame of image after another. For example, the second scanning rate is 60 Hz. Each data-scan period may be just 5.5 μs in this case. More advanced display panel also uses higher scanning rate such as 120 Hz or 240 Hz.

Referring to FIG. 6, each frame is effectively displayed with a display enablement signal VDE provided by the driver IC with a high voltage $V_{GH}$ to enable active scanning through all rows of of the whole display panel in a vertical active time of the frame and with a low voltage $V_{GL}$ to stop scanning in a vertical blank time of the frame. Through a current frame, the emission-control signal EM is a low voltage to turn on the emission-control transistor T6. The sensing-control signal SEN is set to a high voltage $V_{GH}$ to disable the sensing function. The reset signal R and the second scan signal $S_n$ are all set to a high voltage $V_{GH}$ to turn off transistors T7, T2, and T3 related to the sensing function of the display-driving circuit. The first scan signal $G_n$ is scanned through one row after another with a low voltage pulse having a pulse width equal to one data-scan period to execute each data scan sequentially from the first row to the last row ($2560^{th}$) in the current frame. In each data-scan period, respective one data signal $V_{P1}, V_{P2}, \ldots, V_{P2560}$ is loaded to respective data-sensing line of the corresponding one display-driving circuit in the corresponding row of the display panel. After scanning the last row, optionally, the current frame is added with a vertical blank time V-blank following the time V-active of scanning all rows to allow data buffer from the current frame to a next frame. In other words, one frame is equal to a sum of all data-scan periods plus a vertical blank time. In the example, the vertical blank time is set to be equal to a time for scanning 52 rows, i.e., 52 data-scan periods.

In another aspect, the present disclosure also provides a display apparatus including a display panel configured with an array of subpixels. Each subpixel is associated with a display-driving circuit described herein. The display panel is driven in a displaying time to load a data signal to each subpixel by scanning at least a first scan signal progressively with a normal rate row-by-row through the array of subpixels. The display panel is also configured in a sensing time of a non-displaying time to sample a sensing signal $V_{sens}$ to detect electric parameters (such as a threshold voltage) of a driving transistor in the display-driving circuit by scanning at least a second scan signal progressively with a reduced rate row-by-row through the array of subpixels. The non-displaying time is set either after a system starts (power on) and before a displaying time or after the displaying time before the system powers off. The sensing time is at least added in the non-displaying time before the displaying time or optionally added to the non-displaying time before system powers off. The reduced scanning rate for sensing is about 1/10, or 1/60 of the normal scanning rate for the display panel to display one frame of image after another.

Optionally, the display panel of the display apparatus is an organic light-emitting diode display panel. The display apparatus may be provided as one of following products including but not limiting to: smart phone, tablet computer, television, displayer, notebook computer, digital image frame, navigator, or any product or component that have a display function.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

The invention claimed is:

1. A display-driving circuit of a subpixel in a display panel comprising:

a pixel sub-circuit coupled respectively with a first power-supply line, a data-sensing line, a first scan line, and a second scan line and including a driving transistor to determine a drive current flowing to a first electrode of a light-emitting diode based on a data signal received via the data-sensing line during a displaying time;

a sensing-control sub-circuit coupled between a second electrode of the light-emitting diode and the first power-supply line and configured to cut off the drive current through the light-emitting diode under control of a sensing-control signal and to allow a sensing signal to be detected in the data-sensing line in a sensing-scan period in a non-displaying time; and an emission-control sub-circuit coupled between the second electrode of the light-emitting diode and a second power-supply line and configured to pass the drive current for driving the light-emitting diode to emit light under control of an emission-control signal in a data-scan period in the displaying time;

wherein the driving transistor in the pixel sub-circuit comprises a source electrode coupled to the first power-supply line, a drain electrode coupled to the first electrode of the light-emitting diode, and a gate electrode coupled to a first node;

wherein the pixel sub-circuit further comprises:

a second transistor having a source electrode coupled to the first node, a drain electrode coupled to the first electrode of the light-emitting diode, and a gate electrode coupled to the second scan line;

a third transistor having a source electrode coupled to the data-sensing line, a drain electrode coupled to the first node, and a gate electrode coupled to the second scan line;

a fourth transistor having a source electrode coupled to the data-sensing line, a drain electrode coupled to the first node, and a gate electrode coupled to the first scan line; and a storage capacitor coupled between the source electrode and the gate electrode of the driving transistor.

2. The display-driving circuit of claim 1, wherein the driving transistor in the pixel sub-circuit comprises a source electrode coupled to the first power-supply line, a drain electrode coupled to the first electrode of the light-emitting diode, and a gate electrode coupled to a first node;

wherein the pixel sub-circuit further comprising:

a second transistor having a source electrode coupled to the first node, a drain electrode coupled to the first electrode of the light-emitting diode, and a gate electrode coupled to the second scan line;

a fourth transistor having a source electrode coupled to the data-sensing line, a drain electrode coupled to the first node, and a gate electrode coupled to the first scan line; and a storage capacitor coupled between the source electrode and the gate electrode of the driving transistor.

3. The display-driving circuit of claim 1, wherein the light-emitting diode is an organic light-emitting diode; wherein the first electrode of the light-emitting diode is an anode and the second electrode of the light-emitting diode is a cathode.

4. A display apparatus comprising a display panel including an array of subpixels, each subpixel being associated with a display-driving circuit of claim 1.

5. The display-driving circuit of claim 1, wherein the sensing-control sub-circuit comprises a sensing-control transistor having a source electrode coupled to the first power-supply line, a drain electrode coupled to the second electrode of the light-emitting diode, and a gate electrode being supplied with the sensing-control signal, wherein the sensing-control transistor is turned on during the sensing-scan period to set a high voltage level from the first power-supply line to the second electrode of the light-emitting diode to make it in reversed-bias mode.

6. The display-driving circuit of claim 5, wherein the emission-control sub-circuit comprises an emission-control transistor having a source electrode coupled to the second power-supply line, a drain electrode coupled to the second electrode of the light-emitting diode, and a gate electrode being supplied with the emission-control signal, wherein the emission-control transistor is turned on during the displaying time to connect the second electrode of the light-emitting diode to a low voltage level or ground level set for the second power-supply line.

7. A display-driving circuit of a subpixel in a display panel comprising:

a pixel sub-circuit coupled respectively with a first power-supply line, a data-sensing line, a first scan line, and a second scan line and including a driving transistor to determine a drive current flowing to a first electrode of a light-emitting diode based on a data signal received via the data-sensing line during a displaying time;

a sensing-control sub-circuit coupled between a second electrode of the light-emitting diode and the first power-supply line and configured to cut off the drive current through the light-emitting diode under control of a sensing-control signal and to allow a sensing signal to be detected in the data-sensing line in a sensing-scan period in a non-displaying time; and an emission-control sub-circuit coupled between the second electrode of the light-emitting diode and a second power-supply line and configured to pass the drive current for driving the light-emitting diode to emit light under control of an emission-control signal in a data-scan period in the displaying time;

wherein the sensing-control sub-circuit comprises a sensing-control transistor having a source electrode coupled to the first power-supply line, a drain electrode coupled to the second electrode of the light-emitting diode, and a gate electrode being supplied with the sensing-control signal, wherein the sensing-control transistor is turned on during the sensing-scan period to set a high voltage level from the first power-supply line to the second electrode of the light-emitting diode to make it in reversed-bias mode;

wherein the emission-control sub-circuit comprises an emission-control transistor having a source electrode coupled to the second power-supply line, a drain electrode coupled to the second electrode of the light-emitting diode, and a gate electrode being supplied with the emission-control signal, wherein the emission-control transistor is turned on during the displaying time to connect the second electrode of the light-emitting diode to a low voltage level or ground level set for the second power-supply line;

wherein the display-driving circuit further comprises a reset sub-circuit comprising a reset-transistor having a drain electrode coupled to the data-sensing line, a source electrode coupled to a voltage terminal, and a gate electrode coupled a reset terminal, and being controlled by a reset signal from the reset terminal to set the data-sensing line to an initializing voltage in a resetting sub-period imposed at a beginning of the sensing-scan period in the non-displaying time, the initializing voltage being set to be smaller than the high voltage level from the first power-supply line minus a threshold voltage of the driving transistor.

8. The display-driving circuit of claim 7, wherein the data-sensing line is configured in the sensing-scan period per row to store the sensing signal bearing a first voltage which is substantially charged from the initializing voltage up to the high voltage level minus the threshold voltage in a $V_{th}$-establishing sub-period after the resetting sub-period.

9. The display-driving circuit of claim 8, wherein the sensing-scan period is a unit time of scanning progressively one row after another through the display panel within a sensing time; wherein the sensing time is placed between a system-setting time after power-on and a beginning of the displaying time, and/or placed between an end of the displaying time and a system-resetting time before power-off.

10. The display-driving circuit of claim 8, wherein the data-sensing line is alternatively configured in the data-scan period per row to load the data signal containing an original pixel voltage corresponding to the subpixel in a row that is currently been scanned plus the threshold voltage of the driving transistor based on the sensing signal detected from a same data-sensing line during the non-displaying time.

11. A method for driving a display panel comprising:

powering on the display panel to provide a power-supply voltage and system shift-register signals to a respective one pixel sub-circuit of a plurality of pixel sub-circuits in a system-setting time of a non-displaying time, each of the plurality of pixel sub-circuits comprising a driving transistor and associated with a corresponding subpixel having a light-emitting diode;

sampling and storing a sensing signal from a data-sensing line of the respective one pixel sub-circuit in one row of subpixels when sequentially scanning one row after another through the display panel with a first scanning rate in a first sensing time following the system-setting time; and driving the respective one pixel sub-circuit to determine a drive current flowing to the light-emitting diode to drive light emission for displaying a subpixel image based on a corresponding data signal loaded to the data-sensing line of the respective one pixel sub-circuit when sequentially scanning one row after another through the display panel with a second scanning rate in each frame of a displaying time following the non-displaying time, wherein the corresponding data signal is compensated based on the sensing signal sampled for the corresponding subpixel and stored in the first sensing time;

wherein the powering up the display panel comprises providing the power-supply voltage to a first power-supply line coupled to a source electrode of a driving transistor in the respective one pixel sub-circuit, the driving transistor having a drain electrode coupled in series to a first electrode of the light-emitting diode;

providing a first scan signal based on one of the system shift-register signals to a first scan line coupled to a gate electrode of a fourth transistor in the respective one pixel sub-circuit, the fourth transistor having a source electrode coupled to the data-sensing line and a drain electrode coupled to the gate electrode of the driving transistor; and providing a second scan signal based on another of the system shift-register signals to a second scan line coupled to gate electrodes of both a second transistor and a third transistor in the respective one pixel sub-circuit, the second transistor having a source electrode coupled to the gate electrode of the driving transistor and a drain electrode coupled to the first electrode of the light-emitting diode, the third transistor having a source electrode coupled to the data-sensing line and a drain electrode coupled to the gate electrode of the driving transistor;

wherein the light-emitting diode in the corresponding subpixel has a second electrode being coupled via a sensing-control sub-circuit to the first power-supply line and coupled via an emission-control sub-circuit to a second power-supply line;

wherein the sensing-control sub-circuit comprises a sensing-control transistor with a source electrode coupled to the first power-supply line, a drain electrode coupled to the second electrode of the light-emitting diode, and a gate electrode served as a first control terminal thereof;

wherein the emission-control sub-circuit comprises an emission-control transistor having a source electrode coupled to the second power-supply line, a drain electrode coupled to the second electrode of the light-emitting diode, and a gate electrode served as a second control terminal thereof; and wherein each of the driving transistor, the second transistor, the third transistor, the fourth transistor, the sensing-control transistor, and the emission-control transistor is a p-type transistor;

wherein the sampling and storing the sensing signal comprise, in the non-displaying time, applying a sensing-control signal at a low voltage to the first control terminal of the sensing-control sub-circuit and applying an emission-control signal at a high voltage to the second control terminal of an emission-control sub-circuit to enable a sensing function of the respective one pixel sub-circuit;

keeping the first scan signal at a high voltage in the first sensing time;

setting the second scan signal to a low voltage with a pulse width of one sensing-scan period per row in the first sensing time for progressively scanning one row after another through the display panel;

initializing the data-sensing line of the respective one pixel sub-circuit to an initializing voltage in a resetting sub-period in each sensing-scan period per row, the initializing voltage being set to be smaller than the power-supply voltage minus a threshold voltage of the driving transistor;

charging the storage capacitor by the power-supply voltage via the driving transistor and the second transistor to a first voltage equal to the power-supply voltage minus the threshold voltage in an establishing sub-period following the reset sub-period in each sensing-scan period per row;

storing the first voltage into a parasitic capacitor associated with the data-sensing line via the fourth transistor in the establishing sub-period; and sensing the sensing signal carrying the first voltage from the data-sensing line and storing the threshold voltage into a memory of an external compensation module in a sampling sub-period following the establishing sub-period in each sensing-scan period per row.

12. The method of claim 11, wherein applying the sensing-control signal at the low voltage comprises turning the sensing-control transistor on to set the second electrode of light-emitting diode to the power-supply voltage for making the light-emitting diode in a reversed bias mode without light emission in the non-displaying time;

wherein applying the emission-control signal at the high voltage comprises turning the emission-control transistor off to disconnect the second electrode of the light-emitting diode from a second power-supply line.

13. The method of claim 11, wherein the sensing-scan period per row comprises a time duration equal to or less than an inverse value of the first scanning rate, wherein the first scanning rate is configured to be in a range of one tenth to one sixtieth of the second scanning rate, wherein the second scanning rate is normally for the display panel to display image progressively one frame after another in the displaying time.

14. The method of claim 11, wherein the driving the pixel sub-circuit comprises, in the displaying time, applying a sensing-control signal at a high voltage to the first control terminal of the sensing-control sub-circuit and applying an emission-control signal at a low voltage to the second control terminal of the emission-control sub-circuit to enable an emission function of the respective one pixel sub-circuit.

15. The method of claim 14, wherein applying the sensing-control signal at the high voltage comprises turning the sensing-control transistor off to disconnect the second electrode of the light-emitting diode from the first power-supply line; and applying the emission-control signal at the low voltage comprises turning the emission-control transistor on to set the second electrode of light-emitting diode to a low voltage or ground voltage for making the light-emitting diode in a positive bias mode in the displaying time.

16. The method of claim 14, wherein the driving the pixel sub-circuit further comprises:

keeping the second scan signal at a high voltage in the displaying time;

setting the first scan signal to a low voltage with a pulse width of one data-scan period per row to load a data voltage via the data-sensing line to the gate electrode of the driving transistor of the respective one pixel sub-circuit of the corresponding subpixel in a row currently scanned in the data-scan period per row in each frame of the displaying time for progressively scanning from one row to next through the display panel, the data voltage being equal to an original pixel voltage plus the threshold voltage stored in the memory of the external compensation module;

storing a second voltage equal to the power-supply voltage minus data voltage to the storage capacitor in the data-scan period per row, the second voltage being used to determine the drive current;

switching the first scan signal to the high voltage in an emission period following the data-scan period per row in each frame of the displaying time during which the drive current drives light emission of the corresponding subpixel.

17. The method of claim 16, wherein the data-scan period per row comprising a time duration equal to or less than an inverse value of the second scanning rate, wherein each frame in the displaying time is a sum of all data-scan periods plus a vertical blank time for the display panel to display one frame of image;

wherein the displaying time comprises one or more frames;

wherein the displaying time is followed by another non-displaying time including a second sensing time and a system-resetting time before powering off the display panel, wherein the second sensing time is configured to be substantially similar to the first sensing time for the display panel.

* * * * *